US010101106B2

(12) United States Patent
Walton et al.

(10) Patent No.: US 10,101,106 B2
(45) Date of Patent: Oct. 16, 2018

(54) PORTABLE PART OR CONSUMABLE ITEM CARRIER WITH ANTI-JAM FEED SYSTEM WITH EXEMPLARY CONSUMING ITEM SYSTEMS

(71) Applicant: The United States of America as represented by the Secretary of the Navy, Washington, DC (US)

(72) Inventors: Cody L. Walton, Springville, IN (US); Todd H. Heuer, Peyton, CO (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/710,542

(22) Filed: Sep. 20, 2017

(65) Prior Publication Data

US 2018/0172379 A1 Jun. 21, 2018

Related U.S. Application Data

(60) Provisional application No. 62/425,190, filed on Nov. 22, 2016.

(51) Int. Cl.
*F41A 9/79* (2006.01)

(52) U.S. Cl.
CPC ..... *F41A 9/79* (2013.01)

(58) Field of Classification Search
CPC ..... F41A 9/79; F41A 9/61; F41A 9/29; F41A 9/32; F41A 9/34
USPC ..... 89/33.14, 33.2, 33.5, 34
See application file for complete search history.

(56) References Cited

U.S. PATENT DOCUMENTS 2,110,160 A * 3/1938 Larsson ..... F41A 9/79 206/3
2,710,561 A * 6/1955 Dowd ..... F41A 9/79 206/3
4,393,746 A * 7/1983 Rocha ..... F41A 9/79 89/34
4,610,191 A * 9/1986 Schmid ..... F41A 9/79 89/34
5,253,574 A * 10/1993 Sanderson ..... F41A 23/00 89/33.16
6,439,098 B1 * 8/2002 Dillon ..... F41A 9/79 89/33.14
7,546,794 B1 * 6/2009 Sarles ..... F41A 9/79 206/3

(Continued)

*Primary Examiner* — John Cooper
(74) *Attorney, Agent, or Firm* — Christopher A. Monsey

(57) ABSTRACT

Various systems and related methods are provided including various carrier and feed systems that feed belts of consumable items to consuming systems. Exemplary systems relate to on-demand high capacity and speed portable part or consumable item carrier and belt feed system that reduces or eliminates jams or mis-feeds to include jams or mis-feeds due to tilting of belt linked consumable items. Some embodiments also permit consumable items to be carried in an exemplary carrier with removable dividers that create cavities to dispose a series of columns of sequentially folded belt sections extended to a top of the removable dividers that further enable a second belt fold configuration of the belt of consumable items to be folded across the columns of folded belt sections and then oriented to be pulled out of the carrier for use with a consuming system coupled with the carrier.

9 Claims, 8 Drawing Sheets

(56) References Cited

U.S. PATENT DOCUMENTS

| | | | | |
|---|---|---|---|---|
| 9,557,126 | B2 * | 1/2017 | Gotie | F41A 9/34 |
| 2010/0011946 | A1 * | 1/2010 | Ulveraker | F42B 39/26<br>89/34 |
| 2016/0313104 | A1 * | 10/2016 | Williamson | F42B 39/02 |

* cited by examiner

METHOD OF OPERATING A SYSTEM

STEP 301

PROVIDING A CONSUMABLE ITEM PORTABLE FEED SYSTEM COMPRISING:

AN ENCLOSURE HAVING A FLOOR SECTION, FOUR SIDE SECTIONS COMPRISING A FIRST, SECOND, THIRD AND FOURTH SIDES, WHEREIN THE FOUR SIDE SECTIONS ARE FORMED TO DEFINE AN OPENING IN AN UPPER SECTION OF THE FOUR SIDES OPPOSING THE FLOOR SECTION, THE FLOOR SECTION FURTHER INCLUDE ONE OR MORE FIRST DIVIDER STRUCTURES THAT EXTEND PERPENDICULARLY AWAY FROM AND ARE AFFIXED TO THE ENCLOSURE'S FLOOR HAVING A FIRST LENGTH FROM A PROXIMAL END COUPLED TO THE FLOOR SECTION TO AN OPPOSING DISTAL END;

A LID SECTION COUPLED WITH AT LEAST ONE OF SAID ENCLOSURE SIDES SO AS TO COVER THE ENCLOSURE OPENING;

A PLURALITY OF SECOND DIVIDER STRUCTURES EXTENDING AWAY FROM THE ONE OR MORE BASE PORTIONS EACH FORMED WITH A FIRST WIDTH AND FIRST HEIGHT, WHEREIN SAID ONE OR MORE BASE PORTIONS AND A SECTION OF AT LEAST ONE OF SAID PLURALITY OF SECOND DIVIDER STRUCTURES ARE EACH FORMED WITH A RECEIVING CAVITY OR GAP SHAPED TO SLIDEABLY RECEIVE SAID ONE OR MORE FIRST DIVIDER STRUCTURES WHEN SAID SECOND DIVIDER STRUCTURES ARE REMOVEABLY LOWERED OR DISPOSED INTO THE ENCLOSURE, WHEREIN EACH OF THE BASE PORTIONS ARE FORMED TO RESPECTIVELY FIT BETWEEN THE ENCLOSURE SIDE SECTIONS AND FIRST DIVIDER STRUCTURES, AT LEAST ONE OF THE PLURALITY OF SECOND DIVIDER STRUCTURES ARE FORMED WITH A FIRST EXEMPLARY WIDTH DEFINED BY A NON-INTERFERENCE FIT WIDTH BETWEEN AT LEAST TWO OPPOSING SIDES OF SAID ENCLOSURE SIDE SECTIONS, THE PLURALITY OF SECOND DIVIDER STRUCTURES ARE FURTHER FORMED HAVING THEIR FIRST HEIGHT SUCH THAT THEIR DISTAL ENDS LEAVE A GAP BETWEEN THE LID IN AN INSTALLED POSITION, THE DISTAL ENDS OF THE SECOND DIVIDER STRUCTURES ARE FURTHER DEFINED AT LEAST A MULTIPLE OF A WIDTH OF A BELT OF LINKED CONSUMABLE ITEMS FOLDED UPON ITSELF LYING LATERALLY ACROSS THE DISTAL ENDS OF THE PLURALITY OF SECOND DIVIDER STRUCTURES

A LATCH COUPLER THAT COUPLES THE LID TO THE CARRIER SO AS TO FIX THE LID ON AND OVER THE OPENING

FIG. 7A

PORTABLE PART OR CONSUMABLE ITEM CARRIER WITH ANTI-JAM FEED SYSTEM WITH EXEMPLARY CONSUMING ITEM SYSTEMS

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,388) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a portable feed system for product or item use with a variety of equipment items. One set of embodiments include systems related to on-demand high capacity and speed portable part or consumable item carrier and belt feed system. Another set of embodiment relate to portable belt fed ammunition carrier that is portable, is high capacity, permits high speed operation, and reduces or eliminates jams or mis-feeds to include jams or mis-feeds due to tilting of belt linked consumable items. Some embodiments also permit multiple types of ammunitions to be carried in the carrier.

According to an illustrative embodiment of the present disclosure, a carrier and feed structure comprising forming an enclosure having a floor section, four side sections comprising a first, second, third and fourth sides, wherein four side sections are formed to define an opening in an upper section of the four sides opposing said floor section. This embodiment further includes a lid section coupled with at least one of said sides so as to cover said opening. The floor section further comprises one or more first divider structures that extend perpendicularly away from and are affixed to said floor having a first length from a proximal end coupled to the floor section to an opposing distal end. This embodiment further includes a second divider structure comprising one or more base portions and a plurality of second divider structures extending away from the one or more base portions each formed with a first width and first height, wherein said one or more base portions and a section of at least one of said divider structures are formed with a receiving cavity shaped to slideably receive said one or more first divider structures when said second divider structure is removeably lowered or disposed into said carrier, wherein each of said base portions are formed to respectively fit between at least one of said side sections and an opposing one of said one or more base portions, wherein said first width of said second divider structure is defined by a non-interference fit width between said first and an opposing said second side section, said plurality of second divider structures are further formed having said first height so that their distal ends leave a gap between said lid in an installed position and said distal ends defined by no more than three times a width of a belt of linked consumable items folded upon itself within the carrier feed structure. An embodiment of this disclosure can also comprise a latch coupler that couples the lid to the carrier so as to fix the lid on and over the opening.

This disclosure further includes a method of using the container including: providing a portable feed system in accordance with an embodiment of the invention; loading the container comprising sequentially disposing a first plurality portions of the belt of the linked consumables formed from spaced apart and serpentine folded portions into a respective plurality of bays or cavities in the container each formed or defined by said areas of said side sections and said second divider structures so that each of said first plurality of spaced apart and serpentine folded portions are respectively folded into each bay or cavity until such folds are proximate to at least one of said distal ends of said second divider structures, wherein a plurality of second portions of the belt of the linked consumables comprising intermediate sections passing into two adjacent said plurality of bays or cavities are disposed on top of respective ones of said distal ends of said second divider structures, wherein a remaining portion of said belt of the linked consumables are disposed over said first and second plurality portions of the belt in at least one fold and passing an end of said remaining portion of said belt out of a feed aperture in said container proximate to said lid or through said lid; and coupling the end of the remaining portion of the belt to an equipment item that uses or consumes the consumable items in said belt of the linked consumable items.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWING

The detailed description of the drawings particularly refers to the accompanying figures in which:

FIGS. 7A and 7B show another exemplary method in accordance with another embodiment of this disclosure.

DETAILED DESCRIPTION OF THE DRAWING

The embodiments of the invention described herein are not intended to be exhaustive or to limit the invention to precise forms disclosed. Rather, the embodiments selected for description have been chosen to enable one skilled in the art to practice the invention.

Figure 1:
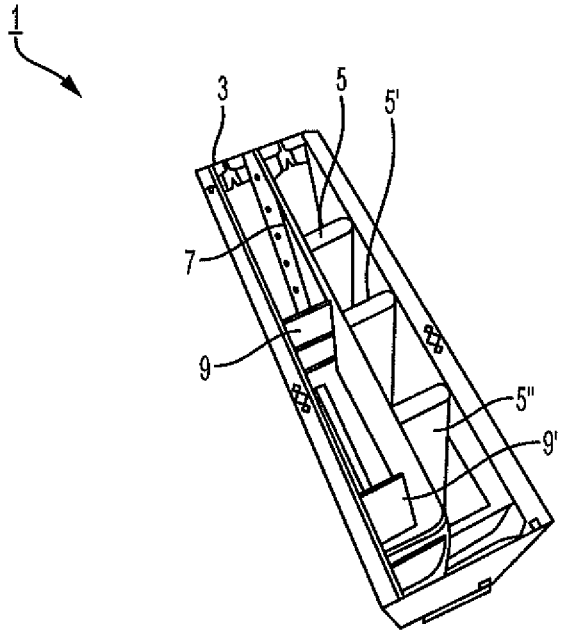
FIG. 1 shows a perspective view of an exemplary carrier and feed structure.

Referring to FIG. 1, a perspective view of an exemplary carrier and feed structure 1 comprising an enclosure 3 having a floor section, four side sections comprising a first, second, third and fourth sides, wherein the four side sections are formed to define an opening in an upper section of the four sides opposing the floor section. This embodiment further includes a lid section (not shown) coupled with at least one of said enclosure 3 sides so as to cover the enclosure opening. The floor section further include one or more first divider structures 9, 9' (See also FIG. 5) that extend perpendicularly away from and are affixed to the enclosure's floor having a first length from a proximal end coupled to the floor section to an opposing distal end. The FIG. 1 embodiment shows the carrier and feed structure 1 with new or second divider structures (5, 5', 5") which are associated with various embodiments of this disclosure as well as without new or second divider structures showing a contrast between an existing carrier and feed structure versus an improved embodiment of such a carrier and feed structure. As noted above, this embodiment further includes second divider structures (5, 5', 5") (see also FIG. 3 for removed dividers) comprising a plurality of second divider structures (5, 5', 5") extending away from the one or more base portions (FIG. 3, 5A, 5A', 5A", 5A'") each formed with a first width and first height, wherein said one or more base portions (FIG. 3, 5A, 5A', 5A", 5A'") and a section of at least one of said divider structures (5, 5', 5") are each formed with a receiving cavity or gap (See FIG. 3, 5D, 5D', 5D") shaped to slideably receive said one or more first divider structures 9, 9' when said second divider structures (5, 5', 5") are removeably lowered or disposed into the exemplary carrier 1, wherein each of the base portions (FIG. 3, 5A, 5A', 5A", 5A'") are formed to respectively fit between the enclosure 3 side sections. A first exemplary width of the second divider structures (5, 5', 5") can be defined by a non-interference fit width between first and opposing said second side sections. Varying distances between second divider structures can affect the reduction in jamming. Smaller distances can reduce the likelihood of jams, but at the cost of reducing the amount of available space. In some embodiments, a ratio between the first exemplary width to an approximate maximum diameter of the consumable items may be greater than 20. For example, in one embodiment, the ratio between the first exemplary width to an approximate maximum diameter of the consumable items may be approximately 34. The plurality of second divider structures (5, 5', 5") are further formed having their first height such that their distal ends leave a gap between the lid in an installed position. The distal ends of the second divider structures (5, 5', 5") can be defined by a multiple, e.g., three times, of a width of a belt of linked consumable items folded upon itself within the carrier feed structure 1. In certain embodiments, a ratio between the first height of the one or more second divider structures to first exemplary width may be approximately 1.17. An embodiment of this disclosure can also comprise a latch coupler that couples the lid to the carrier so as to fix the lid on and over the opening. Note an exemplary embodiment of this disclosure will have the second divider structures (5, 5', 5") extending across the full width and length of the exemplary carrier 1 rather than half way such as is shown in FIG. 1 and FIG. 2 (See FIGS. 3, 4, 5, etc.) as the FIGS. 1 and 2 embodiments have half a wide of the carrier structure with the second divider structures (5, 5', 5") and another half without in order to show a comparison of the carrier 1 with and without the second divider structures (5, 5', 5").

Figure 2:
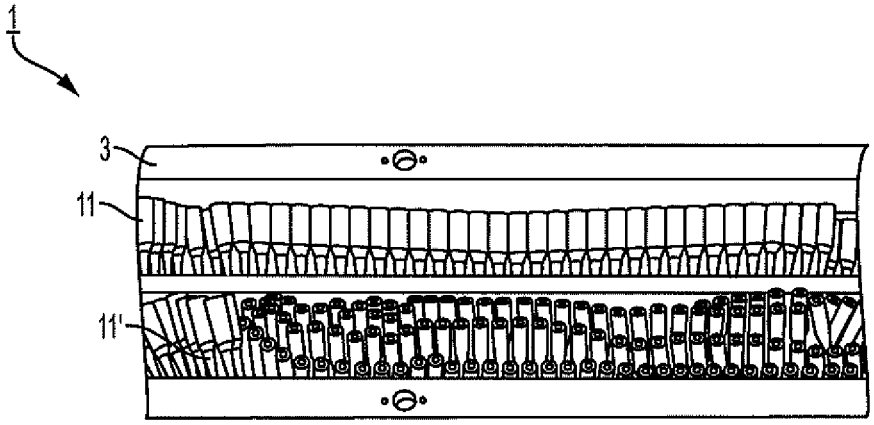
FIG. 2 shows a top-down view of the FIG. 1 embodiment showing an exemplary belt of linked consumable items folded upon itself within the exemplary FIG. 1 carrier and feed structure.

FIG. 2 shows a top-down view of the FIG. 1 embodiment showing the exemplary belt of linked consumable items folded upon itself within the carrier feed structure 1 enclosure 3. A first side 11 of the carrier 1 having the second divider structures (5, 5', 5") which shows the belt of linked consumables lying flat and usable for improved feeding as compared to a second side 11' of the carrier 11 showing rolled belts of linked consumable items which are not lying in a flat or usable orientation for feeding out of the carrier 1 in accordance with the prior art.

Figure 3:
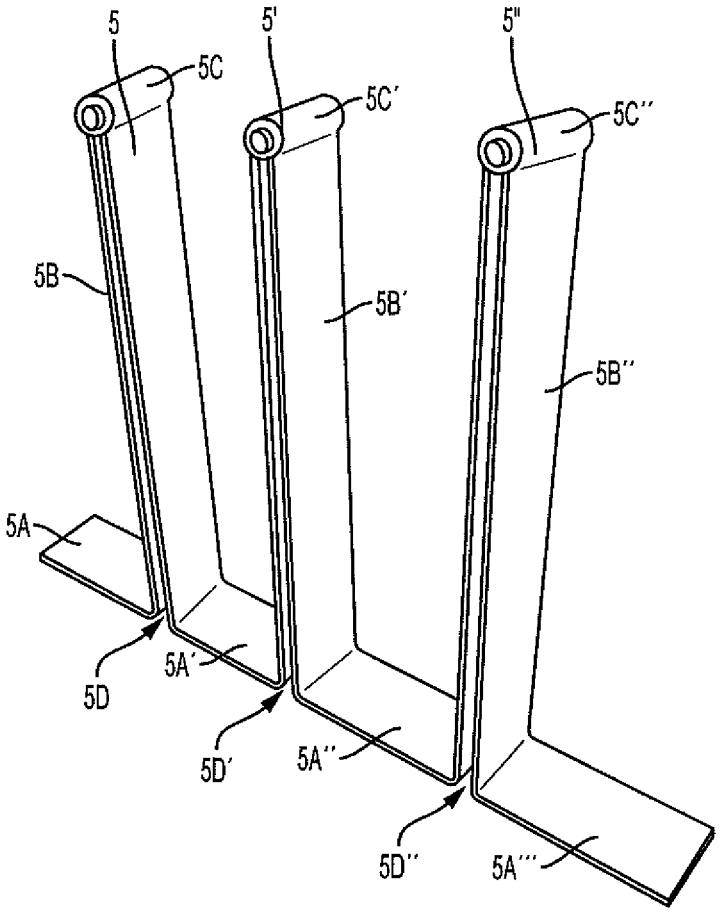
FIG. 3 shows a plurality of exemplary second divider structures such as partially shown in FIGS. 1 and 2 as well as in FIGS. 4 and 5.

FIG. 3 shows the plurality of second divider structures (5, 5', 5") extending away from the one or more base portions (FIG. 3, 5A, 5A', 5A", 5A'") each formed with exemplary first width and first height (e.g., 16 inches), wherein said one or more base portions (5A, 5A', 5A", 5A'") and the section of at least one of the divider structures (5, 5', 5") are each formed with the receiving cavity or gap (5D, 5D', 5D") shaped to slideably receive the one or more first divider structures 9, 9' when the second divider structures (5, 5', 5") are removeably lowered or disposed into the exemplary carrier 1, wherein each of the base portions (5A, 5A', 5A", 5A'") are formed to respectively fit between the enclosure 3 side sections. In some embodiments, the ratio between the first height of at least one of the second divider structures to a maximum diameter of the consumable items is greater than 20. For example, the ratio in some embodiments between the first height of the one or more second divider structures to an approximate maximum diameter of the consumable items is approximately 40. At least one embodiment of the disclosure can include divider rollers or end caps (5C, 5C, 5C") on a distal end of the second divider structures (5, 5', 5") made out of, e.g., aluminum round stock, drilled and tapped to a ¼"×20 TPI specification. Divider rollers or end caps (5C, 5C', 5C") can facilitate smooth movement of an exemplary belt of linked consumable items as the belt is fed through a system. Curved surfaces on the divider rollers or end caps (5C, 5C', 5C") can prevent belts or linked consumable items from getting caught on the divider rollers or end caps (5C, 5C', 5C") or the second divider structures (5, 5', 5") as the belt of linked consumable items moves.

Figure 4:
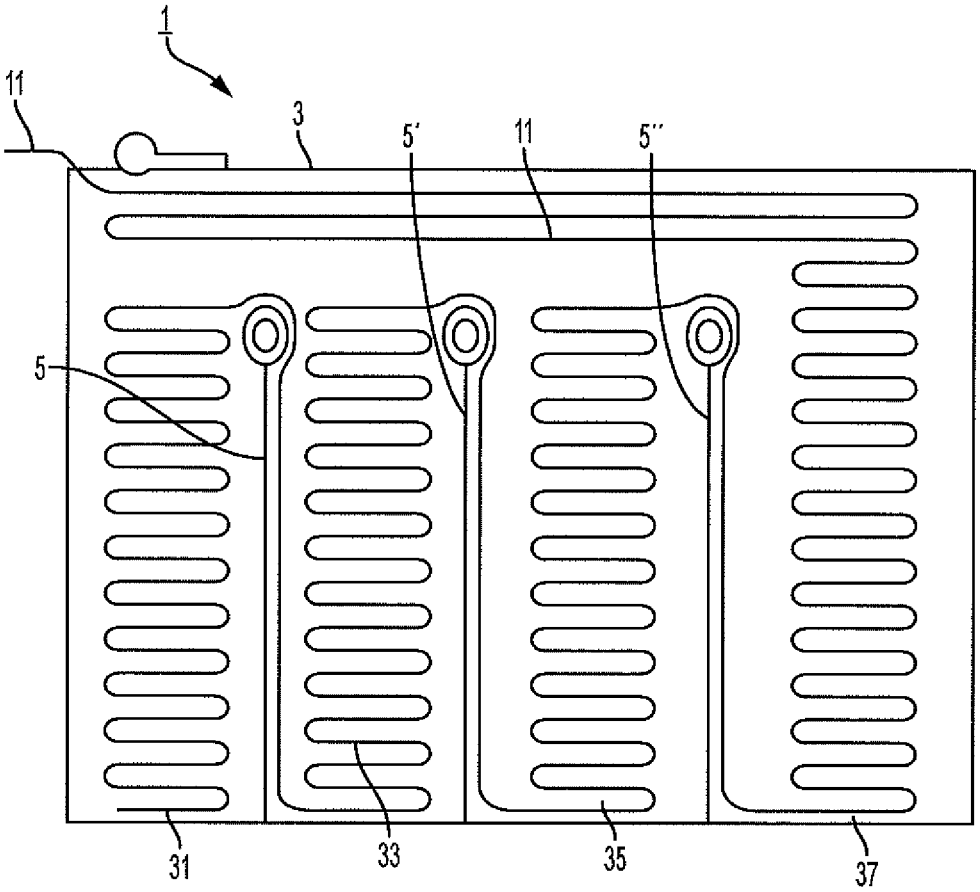
FIG. 4 shows a simplified cross sectional view of an exemplary carrier and feed structure with simplified cross sectional views of FIG. 3 exemplary second divider structures and a simplified cross section of consumable belt items disposed within the carrier and feed structure as well as exemplary second divider structures.

FIG. 4 shows a simplified sectional or cut away side view of an exemplary embodiment of the disclosure. In particular, the exemplary carrier 1 is shown with enclosure side walls 3 and the plurality of second divider structures (5, 5', 5") with the exemplary belt fed consumables 11 which are separating a series of the folded belt fed consumables that are formed into columns 31, 33, 35, 37 of alternating folds of such belt fed consumables with a last set of second folds laying across all of the divider rollers or end caps (5C, 5C, 5C") on the distal ends of the second divider structures (5, 5', 5") to fill up the carrier to the lid. Note some portions of the exemplary disclosure are omitted in FIG. 4 to focus on how the belt fed consumables are disposed into the carrier 1.

Figure 5:
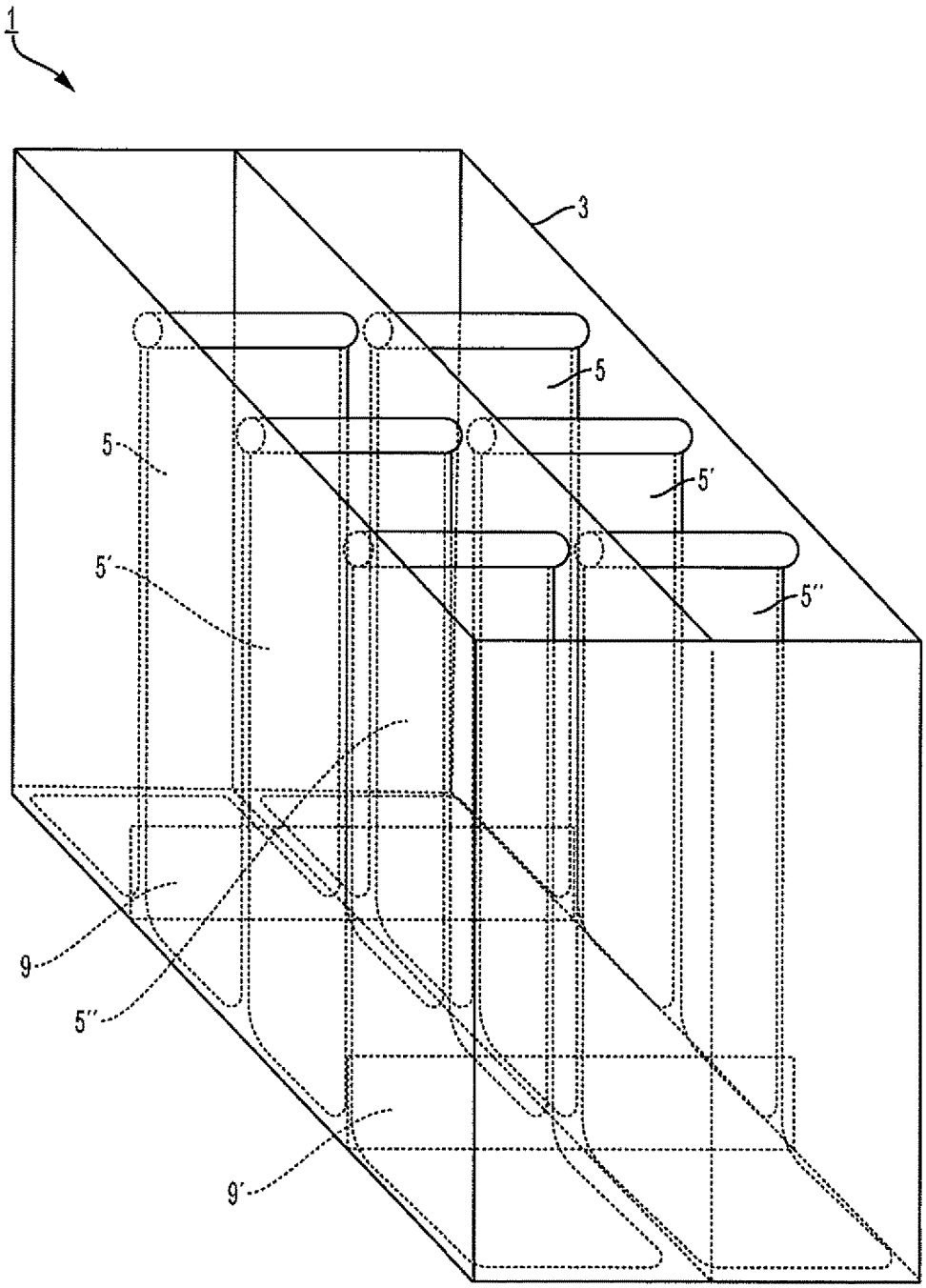
FIG. 5 shows an exemplary simplified view of an exemplary carrier and feed structure with installed simplified exemplary second divider structures in accordance with one embodiment of the invention such as, e.g., in FIGS. 1-4.

FIG. 5 shows another simplified perspective view of an exemplary embodiment of the disclosure showing cut-away views of at least portions of the disclosure show, e.g., FIGS. 1-4.

This disclosure further includes various methods of using the container including: providing a portable feed system in accordance with an embodiment of the invention. For example, a first step can include providing a portable feed system in accordance with an embodiment of the invention such as shown in FIGS. 1-4. A next step can include loading the container comprising sequentially disposing a first plurality portions of the belt of the linked consumables formed from spaced apart and serpentine folded portions into a respective plurality of bays or cavities in the container each formed or defined by said areas of said side sections and said second divider structures so that each of said first plurality of spaced apart and serpentine folded portions are respectively folded into each bay or cavity until such folds are proximate to at least one of said distal ends of said second divider structures, wherein a plurality of second portions of the belt of the linked consumables comprising intermediate sections passing into two adjacent said plurality of bays or cavities are disposed on top of respective ones of said distal ends of said second divider structures, wherein a remaining portion of said belt of the linked consumables are disposed over said first and second plurality portions of the belt in at least one fold and passing an end of said remaining portion of said belt out of a feed aperture in said container proximate to said lid or through said lid; and coupling the end of the remaining portion of the belt to an equipment item that uses or consumes the consumable items in said belt of the linked consumable items.

Figure 6:
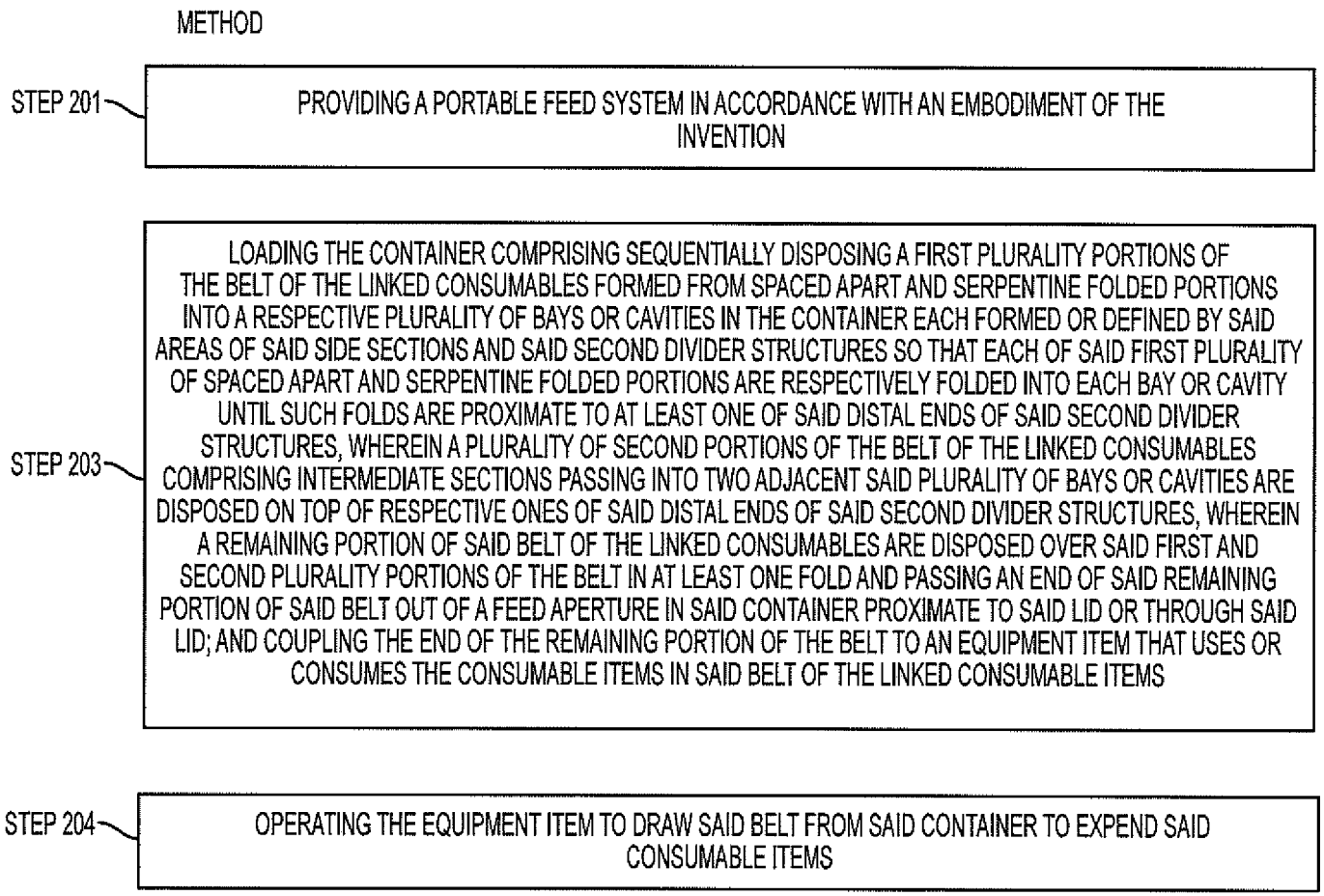
FIG. 6 shows an exemplary method in accordance with one embodiment of this disclosure.

Referring to FIG. 6, a method in accordance with one embodiment of this disclosure can include: Step 201: providing a portable feed system in accordance with an embodiment of the invention. Step 203: loading the container comprising sequentially disposing a first plurality portions of the belt of the linked consumables formed from spaced apart and serpentine folded portions into a respective plurality of bays or cavities in the container each formed or defined by said areas of said side sections and said second divider structures so that each of said first plurality of spaced apart and serpentine folded portions are respectively folded into each bay or cavity until such folds are proximate to at least one of said distal ends of said second divider structures, wherein a plurality of second portions of the belt of the linked consumables comprising intermediate sections passing into two adjacent said plurality of bays or cavities are disposed on top of respective ones of said distal ends of said second divider structures, wherein a remaining portion of said belt of the linked consumables are disposed over said first and second plurality portions of the belt in at least one fold and passing an end of said remaining portion of said belt out of a feed aperture in said container proximate to said lid or through said lid; and coupling the end of the remaining portion of the belt to an equipment item that uses or consumes the consumable items in said belt of the linked consumable items; Step 204: operating the equipment item to draw said belt from said container to expend said consumable items.

Referring to FIG. 7A, a method of operating a system in accordance with one embodiment of this disclosure can include: Step 301: providing a consumable item portable feed system comprising: an enclosure having a floor section, four side sections comprising a first, second, third and fourth sides, wherein the four side sections are formed to define an opening in an upper section of the four sides opposing the floor section, the floor section further include one or more first divider structures that extend perpendicularly away from and are affixed to the enclosure's floor having a first length from a proximal end coupled to the floor section to an opposing distal end; a lid section coupled with at least one of said enclosure sides so as to cover the enclosure opening; a plurality of second divider structures extending away from the one or more base portions each formed with a first width and first height, wherein said one or more base portions and a section of at least one of said plurality of second divider structures are each formed with a receiving cavity or gap shaped to slideably receive said one or more first divider structures when said second divider structures are removeably lowered or disposed into the enclosure, wherein each of the base portions are formed to respectively fit between the enclosure side sections and first divider structures, at least one of the plurality of second divider structures are formed with a first exemplary width defined by a non-interference fit width between at least two opposing sides of said enclosure side sections, the plurality of second divider structures are further formed having their first height such that their distal ends leave a gap between the lid in an installed position, the distal ends of the second divider structures are further defined at least a multiple of a width of a belt of linked consumable items folded upon itself lying laterally across the distal ends of the plurality of second divider structures; and a latch coupler that couples the lid to the carrier so as to fix the lid on and over the opening.

Figure 7B:
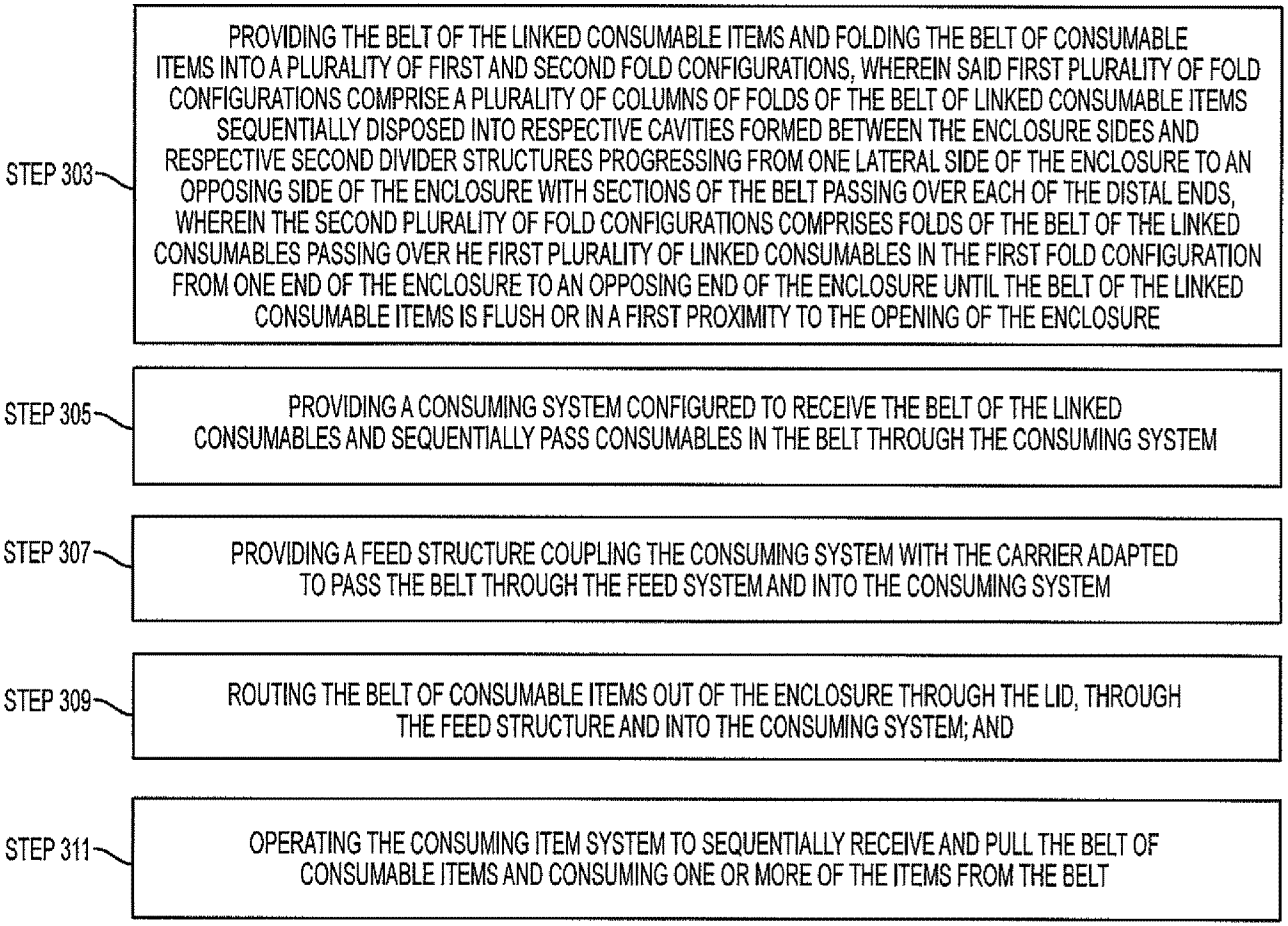

Referring to FIG. 7B, the method of FIG. 7A continues: Step 303: providing the belt of the linked consumable items and folding the belt of consumable items into a plurality of first and second fold configurations, wherein said first plurality of fold configurations comprise a plurality of columns of folds of the belt of linked consumable items sequentially disposed into respective cavities formed between the enclosure sides and respective second divider structures progressing from one lateral side of the enclosure to an opposing side of the enclosure with sections of the belt passing over each of the distal ends, wherein the second plurality of fold configurations comprises folds of the belt of the linked consumables passing over the first plurality of linked consumables in the first fold configuration from one end of the enclosure to an opposing end of the enclosure until the belt of the linked consumable items is flush or in a first proximity to the opening of the enclosure. Step 305: providing a consuming system configured to receive the belt of the linked consumables and sequentially pass consumables in the belt through the consuming system. Step 307: providing a feed structure coupling the consuming system with the carrier adapted to pass the belt through the feed system and into the consuming system. Step 309: routing the belt of consumable items out of the enclosure through the lid, through the feed structure and into the consuming system. Step 311: operating the consuming item system to sequentially receive and pull the belt of consumable items and consuming one or more of the items from the belt.

Figure 8:
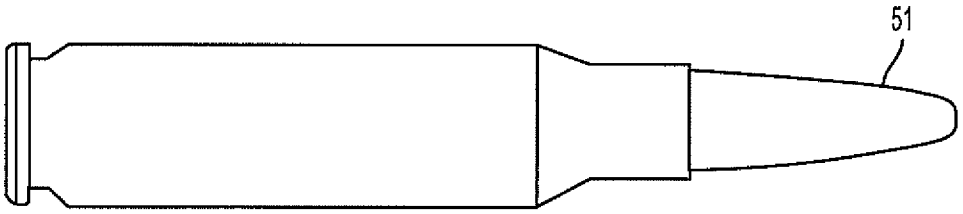
FIG. 8 shows an exemplary consumable item found in an exemplary belt of linked consumable items.

FIG. 8 shows an exemplary consumable item found within an exemplary belt of linked consumable items, where the consumable item is a bullet 51. The bullet 51 has a first end with a first diameter and a second end with a second diameter, wherein the first diameter is larger than the second diameter and the second end tapers down to the second diameter. Because the second end has a smaller diameter, a belt of linked bullets is more prone to individual bullets becoming tilted when layered on top of each other due to the uneven diameters along each bullet 51.

Although the invention has been described in detail with reference to certain preferred embodiments, variations and modifications exist within the spirit and scope of the invention as described and defined in the following claims.

The invention claimed is:

1. A consuming system including a consumable item portable feed system comprising:

an enclosure having a floor section, four side sections comprising a first, second, third and fourth sides, wherein the four side sections are formed to define an opening in an upper section of the four sides opposing the floor section, the floor section further include one or more first divider structures that extend perpendicularly away from and are affixed to the enclosure's floor having a first length from a proximal end coupled to the floor section to a respective opposing distal end;

a lid section coupled with at least one of said enclosure sides so as to cover the enclosure opening;

one or more second divider structures extending away from one or more base portions each formed with a first width and first height, wherein said one or more base portions and a section of at least one of said one or more second divider structures are each formed with a receiving cavity or gap shaped to slideably receive said one or more first divider structures when said one or more second divider structures are removeably lowered or disposed into the enclosure, wherein each of the base portions are formed to respectively fit between the enclosure side sections and first divider structures, at least one of the one or more second divider structures are formed with a first exemplary width defined by a non-interference fit width between at least two opposing sides of said enclosure side sections, the one or more second divider structures are further formed having their first height such that each respective distal end leaves a gap between the lid in an installed position, the distal ends of the one or more second divider structures are further defined at least a multiple of a width of a belt of linked consumable items folded upon itself lying laterally across the distal ends of the one or more second divider structures;

the belt of the linked consumable items folded into a plurality of first and second fold configurations, wherein said first plurality of fold configurations comprise a plurality of columns of folds of the belt of linked consumable items sequentially disposed into respective cavities formed between the enclosure sides and respective second divider structures progressing from one lateral side of the enclosure to an opposing side of the enclosure with sections of the belt passing over each of the distal ends, wherein the second plurality of fold configurations comprises folds of the belt of the linked consumables passing over a first plurality of linked consumables in the first fold configuration from one end of the enclosure to an opposing end of the enclosure until the belt of the linked consumable items is flush or in a first proximity to the opening of the enclosure;

a latch coupler that couples the lid to the enclosure so as to fix the lid on and over the opening;

an equipment item configured to receive the belt of the linked consumables and sequentially pass consumables in the belt through the equipment item; and a feed structure coupling the equipment item with the carrier enclosure adapted to pass the belt through the feed system and into the consuming system equipment item.

2. A system as in claim 1, wherein the equipment item is a machine gun and the belt of linked consumables comprises cartridge items.

3. A system as in claim 2, wherein the cartridge items comprise bullets.

4. A system as in claim 3, wherein each bullet has a first and second end with a first and second diameter, respectively, wherein the first diameter is larger than the second diameter.

5. A system as in claim 1, wherein the first and second fold configurations comprise sequential serpentine folded portions disposed in the enclosure.

6. A system as in claim 1, wherein a ratio between the first height of the one or more second divider structures to an approximate maximum diameter of the consumable items is approximately 40.

7. A system as in claim 1, wherein a ratio between the first exemplary width to an approximate maximum diameter of the consumable items is approximately 34.

8. A system as in claim 1, wherein a ratio between the first height of the one or more second divider structures to first exemplary width is approximately 1.17.

9. A method of operating a consumable item portable feed system comprising:

providing a portable feed system comprising:

an enclosure having a floor section, four side sections comprising a first, second, third and fourth sides, wherein the four side sections are formed to define an opening in an upper section of the four sides opposing the floor section, the floor section further include one or more first divider structures that extend perpendicularly away from and are affixed to the enclosure's floor having a first length from a proximal end coupled to the floor section to a respective opposing distal end;

a lid section coupled with at least one of said enclosure sides so as to cover the enclosure opening;

one or more second divider structures extending away from one or more base portions each formed with a first width and first height, wherein said one or more base portions and a section of at least one of said one or more second divider structures are each formed with a receiving cavity or gap shaped to slideably receive said one or more first divider structures when said one or more second divider structures are removeably lowered or disposed into the enclosure, wherein each of the base portions are formed to respectively fit between the enclosure side sections and first divider structures, at least one of the one or more second divider structures are formed with a first exemplary width defined by a non-interference fit width between at least two opposing sides of said enclosure side sections, the one or more second divider structures are further formed having their first height such that each respective distal end leaves a gap between the lid in an installed position, the distal ends of the one or more second divider structures are further defined at least a multiple of a width of a belt of linked consumable items folded upon itself lying laterally across the distal ends of the one or more second divider structures;

the belt of the linked consumable items folded into a plurality of first and second fold configurations, wherein said first plurality of fold configurations comprise a plurality of columns of folds of the belt of linked consumable items sequentially disposed into respective cavities formed between the enclosure sides and respective second divider structures progressing from one lateral side of the enclosure to an opposing side of the enclosure with sections of the belt passing over each of the distal ends, wherein the second plurality of fold configurations comprises folds of the belt of the linked consumables passing over a first plurality of linked consumables in the first fold configuration from one end of the enclosure to an opposing end of the enclosure until the belt of the linked consumable items is flush or in a first proximity to the opening of the enclosure, wherein the linked consumable items are bullets;

a latch coupler that couples the lid to the enclosure so as to fix the lid on and over the opening;

a consuming system configured to receive the belt of the linked consumables and sequentially pass consumables in the belt through the consuming system; and a feed structure coupling the consuming system with the enclosure adapted to pass the belt through the feed system and into the consuming system loading the container comprising sequentially disposing a first plurality of portions of the belt of linked consumable items formed from spaced apart and serpentine folded portions into a respective plurality of bays or cavities in a container each formed or defined by areas of side sections and a second divider structures so that each of said first plurality of spaced apart and serpentine folded portions are respectively folded into each bay or cavity until such folds are proximate to at least one distal end of said second divider structures, wherein a plurality of second portions of the belt of the linked consumables comprising intermediate sections passing into two adjacent said plurality of bays or cavities are disposed on top of respective ones of said distal ends of said second divider structures, wherein a remaining portion of said belt of the linked consumables is disposed over said first and second plurality portions of the belt in at least one fold and passing an end of said remaining portion of said belt out of a feed aperture in said container proximate to a lid or through said lid;

coupling the end of the remaining portion of the belt to an equipment item that uses or consumes the consumable items in said belt of the linked consumable items; and operating the equipment item to draw said belt from said container to expend said consumable items wherein a first ratio between the first height of the one or more second divider structures to an approximate maximum diameter of the consumable items is approximately 40;

wherein a second ratio between the first exemplary width to an approximate maximum diameter of the consumable items is approximately 34;

wherein a ratio between the first height of the one or more second divider structures to first exemplary width is approximately 1.17; and wherein each bullet has a first and second end with a first and second diameter, respectively, wherein the first diameter is larger than the second diameter.

* * * * *